US008263846B1

(12) United States Patent
Cole et al.

(10) Patent No.: US 8,263,846 B1
(45) Date of Patent: Sep. 11, 2012

(54) INTERNAL VIRTUAL EXTENDER TUBE FOR MARIMBA RESONATOR TUBE

(75) Inventors: Stephen J. Cole, Arcata, CA (US); Ronald Samuels, Arcata, CA (US); Joshua D. Stumpf, Eureka, CA (US)

(73) Assignee: Marimba One, Inc., Arcata, CA (US)

( * ) Notice: Subject to any disclaimer, the term of this patent is extended or adjusted under 35 U.S.C. 154(b) by 317 days.

(21) Appl. No.: 12/838,476

(22) Filed: Jul. 18, 2010

(51) Int. Cl.
*G10D 13/08* (2006.01)

(52) U.S. Cl. ..... 84/402

(58) Field of Classification Search ..... 84/402–410, 84/421

See application file for complete search history.

(56) References Cited

U.S. PATENT DOCUMENTS

| | | | |
|---|---|---|---|
| 967,911 | A | 8/1910 | Haskell |
| 1,128,112 | A | 2/1915 | Deagan |
| 1,173,785 | A | 2/1916 | Deagan |
| 1,207,281 | A | 12/1916 | Deagan |
| 1,969,591 | A | 8/1934 | Willis |
| 2008/0105105 | A1 | 5/2008 | Stevens |

FOREIGN PATENT DOCUMENTS

| | | | |
|---|---|---|---|
| CN | 200993870 | Y * | 12/2007 |

* cited by examiner

*Primary Examiner* — Kimberly Lockett
(74) *Attorney, Agent, or Firm* — David Pressman

(57) ABSTRACT

An improved percussive instrument such as a marimba employs a resonator comprising an external tube (100), an inner or virtual extender tube (115), and a bottom stop (105) and a plug (110) within the outer tube. The region between the external tube and the virtual extender tube defines a volume of air (116). The size, shape, and length of the virtual extender tube enhances performance of the resonator and thereby also the instrument. A key (800) of the instrument is suspended by pivots (805) above the plug and the opening (120) of the resonator. When struck by a mallet (810), the key vibrates and air driven by the key enters the resonator through the opening. When the resonator and key are tuned to the same frequency, or a harmonic thereof, air will enter and leave the resonator in a resonant fashion, creating louder and richer sounds than just the key alone. Numerous variations on shape and location of the various components are possible.

20 Claims, 2 Drawing Sheets

INTERNAL VIRTUAL EXTENDER TUBE FOR MARIMBA RESONATOR TUBE

BACKGROUND

Various percussion instruments (marimbas, xylophones, and vibraphones) have a series of sound bars or keys that a player strikes with a mallet to obtain a desired musical melody or the notes of a composition. A marimba is a keyboard percussion instrument with a resonator tube below each key to enhance the sounds. The lengths of the resonator tubes adjacent the longer or lower-pitched keys must be correspondingly longer for in order to match the lower pitches of their respective adjacent keys. However if a marimba's keys are mounted at a playable height, say 75 cm (about 30 in), the longest or lowest-pitch resonator tubes must be very long—too long to clear the floor. This problem has been overcome by various techniques. One technique is to bend the bottom portions of the lowest-pitch tubes upwardly using U-shaped bends to keep keeping them away from the floor. Another technique is to extend the bottoms of the longer tubes into large box-shaped bottoms, thereby to increase their effective length by approximating a Helmholtz resonator. (The Helmholtz resonator is discussed infra.) A third technique is to mount a shorter, narrower auxiliary virtual-extender tube (VET) on the wall inside the main tube, near the top.

The following is a list of some prior art that illustrates these techniques for effectively extending the lengths of the longer resonator tubes:

| Pat. or Pub. Nr. | Kind Code | Issue or Pub. Date | Patentee or Applicant |
|---|---|---|---|
| 967,911 | B1 | Aug. 23, 1910 | Haskell |
| 1,128,112 | B1 | Feb. 9, 1915 | Deagan |
| 1,173,785 | B1 | Feb. 29, 1916 | Deagan |
| 1,207,281 | B1 | Dec. 5, 1916 | Deagan |
| 1,969,591 | B1 | Aug. 7, 1934 | Willis |
| 20080105105 | A1 | May 8, 2008 | Stevens |

Haskell shows a bass or effective length or virtual extender tube (VET) A mounted inside a main organ tube B. Tube B has an adjustable tuning stopper E at its top and tube A is suspended from stopper E by two threaded rods F (Haskell, FIG. 5) that are attached to the outside of tube A. Thus when adjusting stopper E is moved, VET A moves with it. Instead of dangling freely from stopper E, the bottom end of VET A is springably urged against the inside of tube B. Haskell's organ pipes comprise open exterior tubes with closed interior extension tubes for lowering the resonant frequency of the pipe. The fundamental resonant frequency of a closed organ pipe is given by the formula $f=(v/4L')/4$, where v is the speed of sound in air, and L' is the length of the pipe. Placing a VET inside the organ pipe effectively increases the length of the pipe by an amount equal to the length of the extender tube, thereby lowering the resonant frequency of the pipe. This addition enables construction of organ pipes that are shorter than conventional organ pipes yet have the same fundamental resonant frequency.

In his patents, Deagan shows telescoping, interior resonating tubes or VETs for pianos and marimbas. His inner resonating tubes are adjustably secured within the main tubes by clamping screws ('112 patent) and clamping bars ('785 and '281 patents). In his '112 patent, Deagan's VET is partially conical and terminates in a thin diaphragm adjacent the vibrating body, i.e., tone bar, of the instrument. In his '785 and '281 patents, his interior resonating tube is partially conical and terminates in a thin diaphragm at the end of the tube opposite the vibrating body.

Haskell and Deagan's VETs are situated within the main resonating tube. Excitation of the air in the column is initiated at the entrance to the external tube.

Willis shows organ pipes with various tuning tubes that are slidably suspended from the sides of the main tubes by webs between the two tubes. Once the tubes are in the desired position, the webs can be secured to the pipes by solder.

Stevens shows a resonating tube for a percussion instrument. A tubular resonator is bent or formed into a smooth L-shaped, J-shaped, or U-shaped curve that is either open or stopped on one end.

Another tubular resonator is ascribed to physicist and physiologist Hermann von Helmholtz. In 1863, Helmholtz published a book, "On the Sensations of Tone as a Physiological Basis for the Theory of Music". He describes a resonator, well known and understood today, that comprises an external necked region that is coupled on one end to a resonant cavity and on the other end to open air. Blowing across the neck of the resonator, or otherwise driving air into the resonator and then allowing the air to escape produces a tone whose fundamental frequency is given by the well-known Helmholtz equation $f_H=(v/2\pi)(A/V_oL)^{1/2}$, where $f_H$ is the Helmholtz frequency, v is the speed of sound in air, A is the cross-sectional area of the neck, $V_o$ is the volume of the cavity, and L is the length of the neck. An example is the tone generated by blowing across the neck of a soft drink bottle.

While all of the prior-art resonators are adaptable to percussion instruments, we found that they have one or more sound-quality drawbacks, including a weak fundamental frequency and distortion of the sounds created by the keys and their respective tubes.

SUMMARY

We have discovered an improved resonator for percussion instruments such as marimbas. Our resonator comprises an exterior resonating tube which surrounds an open interior tube (VET) that extends downwardly from the top of the exterior tube into the exterior tube, thus forming a resonant chamber that is neither an organ pipe, nor an organ pipe with an extender tube, nor a true Helmholtz resonator. As such, our resonator enables a percussion instrument to produce pleasant tonal qualities heretofore largely unheard. The opening in our resonating tube is mounted adjacent the vibrating tone bar or key of the percussion instrument. Tuning of the combination is accomplished by moving a stop at the lower end of the exterior tube and adjusting the area and length of the opening in the interior tube.

DRAWING FIGURES

Figure 1:
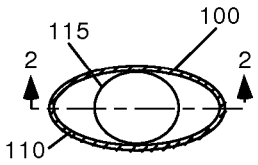
FIG. 1 shows a top view of a preferred embodiment.

| REFERENCE NUMERALS | | | |
|---|---|---|---|
| 100 | Tube | 105 | Stop |
| 110 | Plug | 115 | Inner tube (VET) |
| 120 | Opening | 125 | Opening |
| 800 | Key | 805 | Pivot |
| 810 | Mallet | 1000 | Curved Region |

FIRST EMBODIMENT

Description

FIGS. 1 through 8

Figure 2:
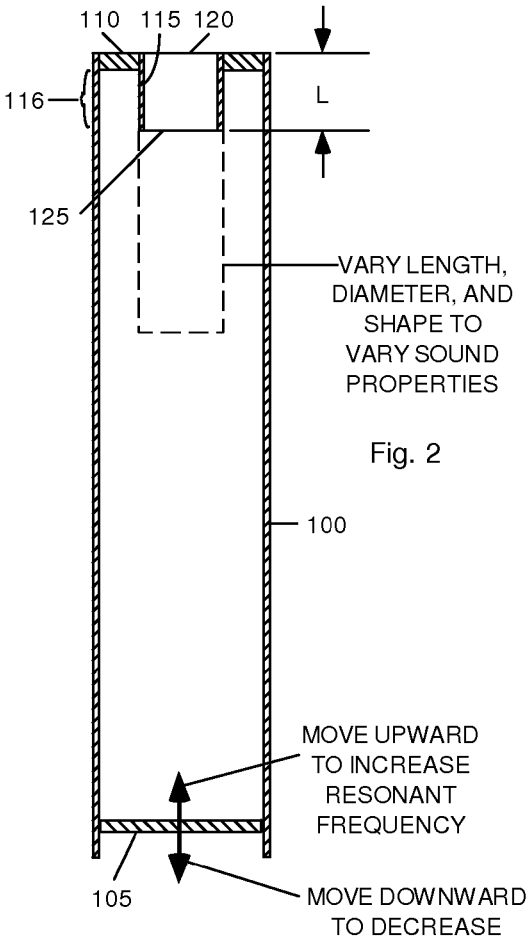
FIG. 2 shows a cross-sectional, side view of the embodiment of FIG. 1.
Figure 8:
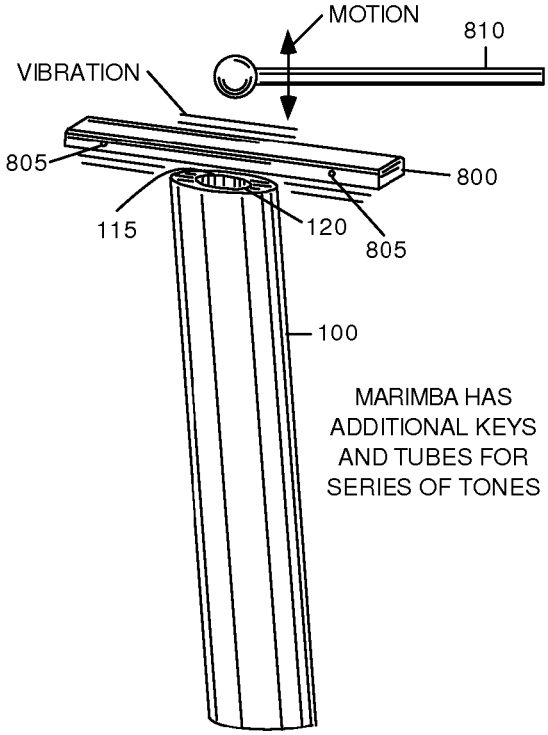
FIG. 8 shows a preferred embodiment in use.

FIG. 1 shows a top view of a resonator tube with an effective length extender according to one aspect of a preferred embodiment and FIG. 2 shows a cross-sectional side view of the tube of FIG. 1. An outer tube 100 of a generally oval cross-section as shown provides a resonant chamber and is mounted below a marimba key 800, as shown in FIG. 8. The cross section of tube 100 can also be circular or of any other shape. The actual mounting of tube 100 below key 800 is not shown as it is well known and shown in some of the above patents and others. It is generally hung on pivots (not shown) that allow it to resonate freely. To prevent the passage of air into tube 100, it is sealed at its lower end by a movable bottom stop 105 and at its upper end by a fixed top plug 110.

When key 800 is arranged to produce a note at the lower end of the scale, tube 100 must be relatively long—too long to clear the floor (not shown) below. In order to lower the resonant frequency of tube 100 so that it matches the tone of key 800 above, it has been curved upward, provided with a resonating box at its lower end, or provided with a smaller VET (virtual extender tube) on the wall and inside the main tube, near the top, as discussed above. However these techniques have certain sound quality drawbacks, including a weak fundamental frequency and distortion of the sounds created by the keys and their respective tubes.

These problems are reduced by providing an inner, virtual extender tube (VET) 115 with an upper opening 120 and a lower opening 125. VET 115 is mounted in a hole in plug 110 and extends downward into tube 100. VET 115 preferably is generally cylindrical in shape.

The shape, position, and size of tube 100, plug 110, stop 105, VET 115, and the materials of which they are made all influence the characteristics of sound produced by this embodiment. These physical properties can be altered by the manufacturer to enhance various aspects of sound produced by the resonator, including its resonant frequency.

Figure 3:
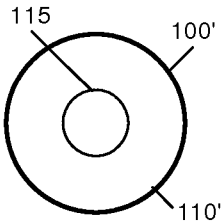
FIGS. 3 through 7 show variations on the embodiment of FIGS. 1 and 2.
Figure 4:
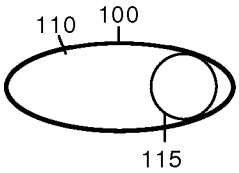
Figure 5:
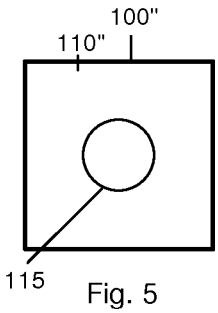
Figure 6:
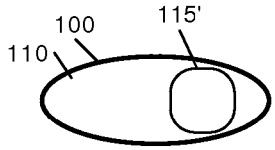
Figure 7:
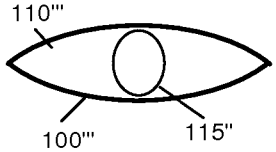

For example outer tube 100 can have, in cross section, a circular shape 100', as shown in FIG. 3, an oval shape (FIG. 4), a square or rectangular shape 100" (FIG. 5), a flattened circular shape (FIG. 6), or a double-concave shape 100'" (FIG. 7).

Bottom plugs 110' to 110'" should have shapes that conform to those of tubes 100'-100'", respectively, as shown in FIGS. 4 to 7.

VET 115 can also have various shapes and positions. It is circular and centered in FIGS. 2, 3, and 5 while in FIGS. 4 and 5 it is circular and off-center. In FIG. 6 VET 115' is off-center and rectangular with rounded corners while in FIG. 7 VET 115" is oval and centered.

Unlike the true Helmholtz resonator, supra, our arrangement includes a predetermined volume of air 116 (FIG. 2) that surrounds VET 115. While it may be possible to derive a formula for the resonant frequency of our structure, such a derivation would be a complex undertaking and recalculation would be necessary for each structural aspect of our embodiments. We have chosen to simply construct, test, and optimize each resonator according to our design. Among other variables, the sound properties of our resonator change with the length, L (FIG. 2), diameter, and shape of VET 115. Each of these changes affects the volume of air 116 that surrounds the VET.

VET 100, bottom stop 105, top plug 110, and tube 115 can be made of metal, wood, plastic, glass, or stone, or a combination thereof. Stop 105 preferably forms a tight, slidable friction fit within tube 100. Alternatively, stop 105 can be glued, pinned, or crimped in place once the resonator has been tuned to the desired frequency. As indicated in FIG. 2, moving bottom stop upward will increase the resonant frequency of tube 100. Increasing the length L of VET 115 will lower the resonant frequency of tube 100. Moving VET 115 to an off-center position in tube 100 will cause the fundamental frequency to be less dominant and tends to change the pitch to a lower frequency. Making the shape of VET 115 non-circular will change the shape or timbre of the sound produced by striking the respective key. E.g., making VET 115 with a double-convex shape (FIG. 7) will alter the volume of the sound and change its harmonic structure. A skilled marimba designer will thus be able to select a wide range of sound shapes or timbres by changing the size, shape, and position of VET 115.\

Operation

FIG. 8

A marimba has tone bar or key such as key 800 (FIG. 8) that is suspended by well-known pivots 805 over opening 120 in the top of the resonator. In use, the player strikes key or tone bar 800 with a mallet 810, causing it to vibrate its resonant frequency and also at a series of harmonics of this resonant frequency. This will cause the adjacent air to undergo rapid rarefactions and compressions in well-known fashion, causing air to move in and out of the resonator through the upper opening in VET 115.

E.g., if key 800 is sized and shaped to resonate at the note C2, i.e., two octaves below middle C, its fundamental vibration frequency will be 65.4 Hz and it will also vibrate at a set of higher frequencies that give it a characteristic timbre (sound quality). To enable an adjacent resonant oval tube 100 to resonate at this frequency yet still clear the floor below, a VET 115 is mounted in tube 100. Tube 100 has a length of 81.3 cm (32 in) and a major axis dimension of 25.4 cm (10 in) and a minor axis of 7.6 cm (3 in). VET 115 has a length of 27.9 cm (11 in) and a diameter of 7 cm (2.75 in). Both tubes are made of aluminum and plug 110 and stop 105 are made of a thermoplastic material, although other materials can be used. The inner and outer tubes for other keys having different resonant frequencies would have different sizes in accordance with the fundamental frequencies of their respective keys.

Prior to assembly, the resonant frequency of the resonator is determined by selecting the size, position, and shape of VET 115 in relation to tube 100. After assembly, the resonator is fine-tuned to the resonant frequency of key 800, by moving stop 105 upward or downward within tube 100. When the resonator is tuned to the frequency of key 800, the sound produced by the striking of key 800 and emanating from the combination of the key and resonator is enhanced, both in volume and in aesthetic quality.

A marimba contains one or more assemblies like that shown in FIG. 8. In such an instrument, resonators of varying size and shape can be used. Alternatively, all tubes can have the same shape, but will be different sizes in order to match the frequencies their respective keys. We have found that the fundamental frequency of any lower key's sound will be enhanced and distortion will be reduced by use of our VET as compared with prior-art VET arrangements.

ALTERNATIVE EMBODIMENT

Description and Operation

Figure 9:
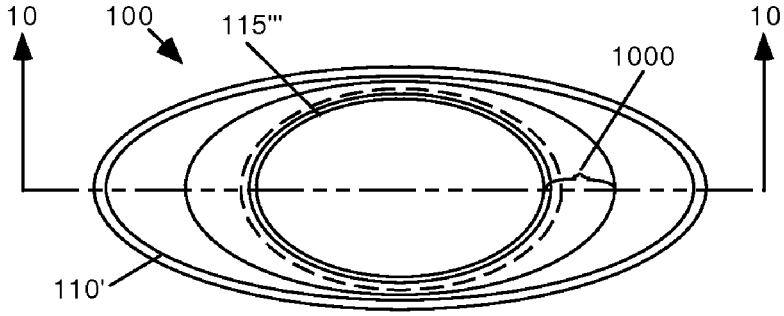
FIGS. 9 and 10 show top and cross-sectional views of one aspect of an alternative embodiment.
Figure 10:
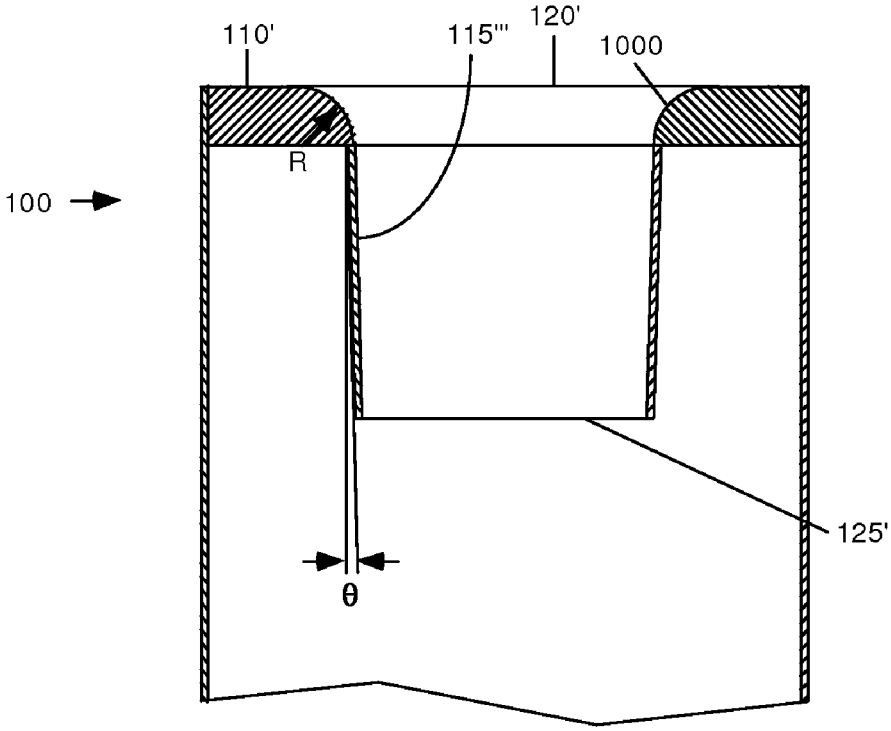

FIGS. 9 and 10

FIGS. 9 and 10 show top and cross-sectional views of one aspect of an alternative embodiment. FIG. 9 shows tube 100 fitted with a top plug 110' that differs from top plug 100 (FIGS. 1 and 2) in that plug 100' joins tube 115''' via a curved or radiused corner region 1000 having a radius of curvature R (FIG. 10). In addition, instead of being a right circular cylinder, as is tube 115 in FIG. 2, tube 115' has sloped sides and decreases in diameter as tube 115''' descends vertically downward from plug 110' into tube 100. The decrease in diameter of tube 115 is indicated by the angle θ (FIG. 10).

Radius R typically varies from 1 mm to 1 cm, although other radii can be used. Instead of a circular shape with a fixed radius, an exponential or other gradual, convex shape can be used in region 1000. Angle θ varies from zero to 10 degrees, although other angles can be used.

The addition of the variables R and θ permits the designer to achieve tonal variations beyond those available from the first embodiment alone.

CONCLUSION, RAMIFICATIONS, AND SCOPE

Accordingly the reader will see that, according to one or more aspects, we have provided an improved marimba that employs a novel resonator to produce aesthetically pleasing sounds with an enhanced fundamental frequency and less distortion.

While the above description contains many specificities, these should not be construed as limitations on the scope, but as exemplifications of some presently preferred embodiments. Many other ramifications and variations are possible within the teachings. For example, the components shown can be painted various colors, chrome plated, and the like. A plurality of resonators having different shapes can be used on the same instrument. Some resonators or their components can be made of one material, while others are made of a different material. In addition, all aspects of the preferred embodiment are scalable to any size. Many other shapes are possible and many other materials or combinations of materials can be used. Instead of hanging vertically, the resonator can be hung at any angle so long as the key is capable of exciting vibrations within the resonator. In addition to use on a marimba, the resonator can be used on a vibraphone or any other percussive instrument that employs one or more resonator tubes.

Thus the scope should be determined by the appended claims and their legal equivalents, and not by the examples given.

The invention claimed is:

1. A resonator for a percussive instrument, comprising:

an outer tubular element having first and second ends with a plug at said first end and a stop at or near said second end, said plug having upper and lower surfaces, an open internal tubular element or virtual extender tube having first and second ends, said first end of said internal tubular element lying substantially in the plane containing said plug at said first end of said external tubular element, said second end of said internal tubular element extending into said external tubular element a predetermined distance, said external tubular element and said internal tubular element defining a predetermined volume of air therebetween, whereby when a resonance is excited in said resonator the quality of said resonance is enhanced by said internal tubular element and its effect on the total volume of air within said outer tubular element.

2. The resonator of claim 1 wherein said stop is slidably movable within said external tubular element and can be fixed within said external tubular element so that said external tubular element can be tuned to a resonant frequency and then fixed as tuned.

3. The resonator of claim 1 wherein the shapes of said external and said internal tubular elements, said plug, and said stop have cross-sectional shapes selected from the group consisting of square, rectangular, double-convex, rectangular with rounded corners, and oval.

4. The resonator of claim 1 wherein said internal tubular element is positioned coaxially and asymmetrically with said external tubular element.

5. The resonator of claim 1 wherein said internal tubular element is positioned symmetrically within said external tubular element.

6. The resonator of claim 1, further including a key of a percussive instrument, said resonator being mounted adjacent said key so that said resonator will be excited by sound from said key when said key is struck.

7. The resonator of claim 1 wherein said resonator is tuned to a frequency substantially equal to the resonant frequency of a key of a percussive instrument.

8. The resonator of claim 1, further including a radiused or curved region between said upper surface of said plug and said first end of said inner tubular element where said inner tubular element joins said lower surface of said plug.

9. The resonator of claim 1 wherein said second end of said inner tubular element is smaller in diameter than said first end of said inner tubular element.

10. A method for creating resonant tones from a percussive instrument, comprising:

providing a resonator comprising an outer tubular element having first and second ends with a plug having upper and lower surfaces and an opening at said first end and a stop at or near said second end, said resonator further including an open internal tubular element having first and second ends, said first end of said internal tubular element lying substantially in the plane containing said plug and said first end of said external tubular element, said second end of said internal tubular element extending into said external tubular element a predetermined distance, said external tubular element and said internal tubular element defining a predetermined volume of air therebetween, providing a percussive instrument having a mallet and a key that is suspended so as to be able to vibrate when struck by said mallet, suspending said internal tubular element adjacent to said key, striking said key with said mallet, thereby causing air to move in and out of said resonator, whereby when said key is struck by said mallet said resonator and said key create an enhanced resonant tone.

11. The method of claim 10, further including moving said stop within said external tubular element in order to tune said resonator to a frequency selected from the group consisting of the same, a harmonic multiple, or a subharmonic of the resonant frequency of said key.

12. The method of claim 10, further including sliding said stop within said external tubular element so as to tune said resonator and then securing said stop within said external tubular element by means selected from the group consisting of gluing, friction fitting, pinning, and crimping.

13. The method of claim 10 wherein the shapes of said external and said internal tubular elements, said plug, and said stop are selected from the group consisting of square, rectangular, double-convex, rectangular with rounded corners, and oval.

14. The method of claim 10 wherein the position of said internal tubular element is selected from the group consisting of symmetrical and asymmetrical mounting within said external tubular element.

15. The method of claim 10, further including a series of said keys and respective resonators, said keys and said resonators being tuned to a series of frequencies.

16. The method of claim 10 wherein said percussive instrument is selected from the group consisting of marimbas and vibraphones.

17. The method of claim 10 wherein said inner tubular element further includes sloped sides.

18. The method of claim 10 wherein said plug further includes a radiused or curved region joining said upper and lower surfaces of said plug at said opening and said inner tubular element is joined to said lower surface of said plug at said opening so that the diameter of said element and the diameter of said opening are substantially equal.

19. A resonator for a percussive instrument having at least one key, comprising:

an outer tube having first and second ends with a plug at said first end and a stop near said second end, an open internal or virtual extender tube having first and second ends, said first end of said internal tube lying substantially in the plane containing said plug and said first end of said external tube, said second end of said internal tube extending into said external tube a predetermined distance, said external tube and said internal tube being arranged to define a predetermined volume of air and said external tube being capable of enhancing a resonance excited within said resonator, whereby when a resonance is excited in said resonator by striking said key, the quality of sound emanating from said instrument is enhanced.

20. The resonator of claim 19 wherein said outer tube is vertically mounted and further including a percussive key mounted above said outer tube, so that said plug is at a top end of said outer tube adjacent said key and said stop is at a bottom end of said outer tube, the position of said stop being adjustable within said outer tube to adjust the resonant frequency of said outer tube, and wherein said inner tube is joined to said plug at a radiused or curved region and said inner tube further includes sloped sides.

* * * * *